US005120053A

United States Patent [19]

Head et al.

[11] Patent Number: 5,120,053

[45] Date of Patent: Jun. 9, 1992

[54] BASKETBALL GAME APPARATUS

[76] Inventors: Peter S. Head; Mary E. Head, both of Star Rte., Hortonville, N.Y. 12745

[21] Appl. No.: 740,138

[22] Filed: Aug. 5, 1991

[51] Int. Cl.[5] ..... A63B 63/08

[52] U.S. Cl. ..... 273/1.5 R

[58] Field of Search ..... 273/1.5 R, 1.5 A, 141 R, 273/450

[56] References Cited

U.S. PATENT DOCUMENTS

| | | | |
|---|---|---|---|
| 2,861,809 | 11/1958 | Fischl | 273/141 R |
| 3,137,503 | 6/1964 | Ballard | 273/1.5 R |
| 3,589,723 | 6/1971 | Glass et al. | 273/450 |
| 3,941,382 | 3/1976 | Clark | 273/1.5 A |
| 5,007,636 | 4/1991 | Pagani | 273/450 X |

OTHER PUBLICATIONS

Korney Board Aids, p. 13, Dec. 1988, Spot Shots.

*Primary Examiner*—Paul E. Shapiro

*Attorney, Agent, or Firm*—Leon Gilden

[57] ABSTRACT

A game includes a plurality of support discs mounted in a matrix upon a basketball court. Each player of a plurality of players in turn is positioned on a sequentially numbered disc and attempts successful throwing of a basketball through an associated net relative to the basketball court. Complexity of play is enhanced by providing selective player or all players in sequence to utilize a spinner assembly to direct each sequential player as to the manner of throw of the basketball attempted. Further, modified disc support structure is also provided for enhanced complexity of play.

2 Claims, 4 Drawing Sheets

BASKETBALL GAME APPARATUS

BACKGROUND OF THE INVENTION

1. Field of the Invention

The field of invention relates to game apparatus, and more particularly pertains to a new and improved basketball game apparatus wherein the same is directed to the play of a basketball game in a predetermined sequentially provided manner.

2. Description of the Prior Art

Basketball game apparatus has been utilized in the prior art in a manner to enhance basketball play or to simulate such play. the instant invention attempts to overcome deficiencies of the prior art by providing a basketball game apparatus requiring individuals to utilize an active participation in a basketball game to enhance hand/eye coordination in play of a basketball type game.

Prior art relative to basketball games is exemplified in U.S. Pat. No. 4,239,214 to Brenner wherein a basketball shot-making game is provided with a plurality of backboard and hoop arrangements to add complexity to basketball play.

U.S. Pat. No. 4,036,494 to Hayes sets forth a basketball game device wherein a basketball backboard includes a plurality of pivotal wings to enable various deflecting shots dirceted from the wings relative to a centrally located basketball net.

As such, it may be appreciated that there continues to be a need for a new and improved basketball game apparatus as set forth by the instant invention which addresses both the problems of ease of use as well as effectiveness in construction and in this respect, the present invention substantially fulfills this need.

SUMMARY OF THE INVENTION

In veiw of the foregoing disadvantages inherent in the known types of basketball game apparatus now present in the prior art, the present invention provides a basketball game apparatus wherein the same is arranged to position players in various sequential locations about a basketball court to attempt directing of a basketball from the court to a basketball net or goal. As such, the general purpose of the present invention, which will be described subsequently in greater detail, is to provide a new and improved basketball game apparatus which has all the advantages of the prior art basketball game apparatus and none of the disadvantages.

To attain this, the present invention provides a game including a plurality of support discs mounted in a matrix upon a basketball court. Each player of a plurality of players in turn is positioned on a sequentially numbered disc and attempts successful throwing of a basketball through an associated net relative to the basketball court. Complexity of play is enhanced by providing selective player or all players in sequence to utilize a spinner assembly to direct each sequential player as to the manner of throw of the basketball attemped. Further, modified disc support structure is also provided for enhanced complexity of play.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is inportant, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved basketball game apparatus which has all the advantages of the prior art basketball game apparatus and none of the disadvantages.

It is another object of the present invention to provide a new and improved basketball game apparatus which may be easily and efficiently manufactured and marketed.

It is a further object of the present invention to provide a new and improved basketball game apparatus which is of a durable and reliable construction.

An even further object of the present invention is to provide a new and improved basketball game apparatus which is susceptible of a low cost of manufacture with regard to both materials and labor, and which accordingly is then susceptible of low prices of sale to the consuming public, thereby making such basketball game apparatus economically available to the buying public.

Still yet another object of the present invention is to provide a new and improved basketball game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention willl be better understood and objects other than those set forth above will become apparent when consideration is given to the following detailed description thereof. Such description makes reference to the annexed drawings wherein:

FIG. 7 is an isometric illustration of the invention in use relative to an associated basketball court.

DESCRIPTION OF THE PREFERRED EMBODIMENT

Figure 1:
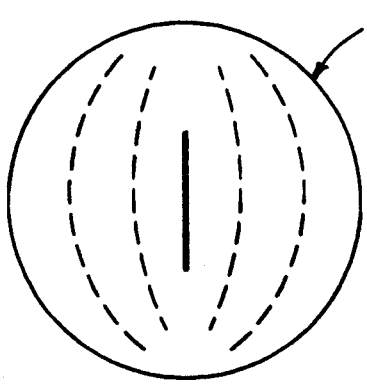
FIG. 1 is an orthographic top view of a support disc utilized by the invention.
Figure 2:
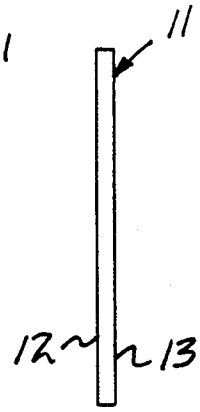
FIG. 2 is an orthographic side view of the disc as set forth in FIG. 1.
Figure 3:
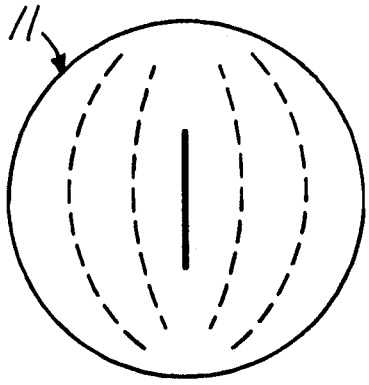
FIG. 3 is an orthographic rear view of the disc as set forth in FIG. 1.
Figure 4:
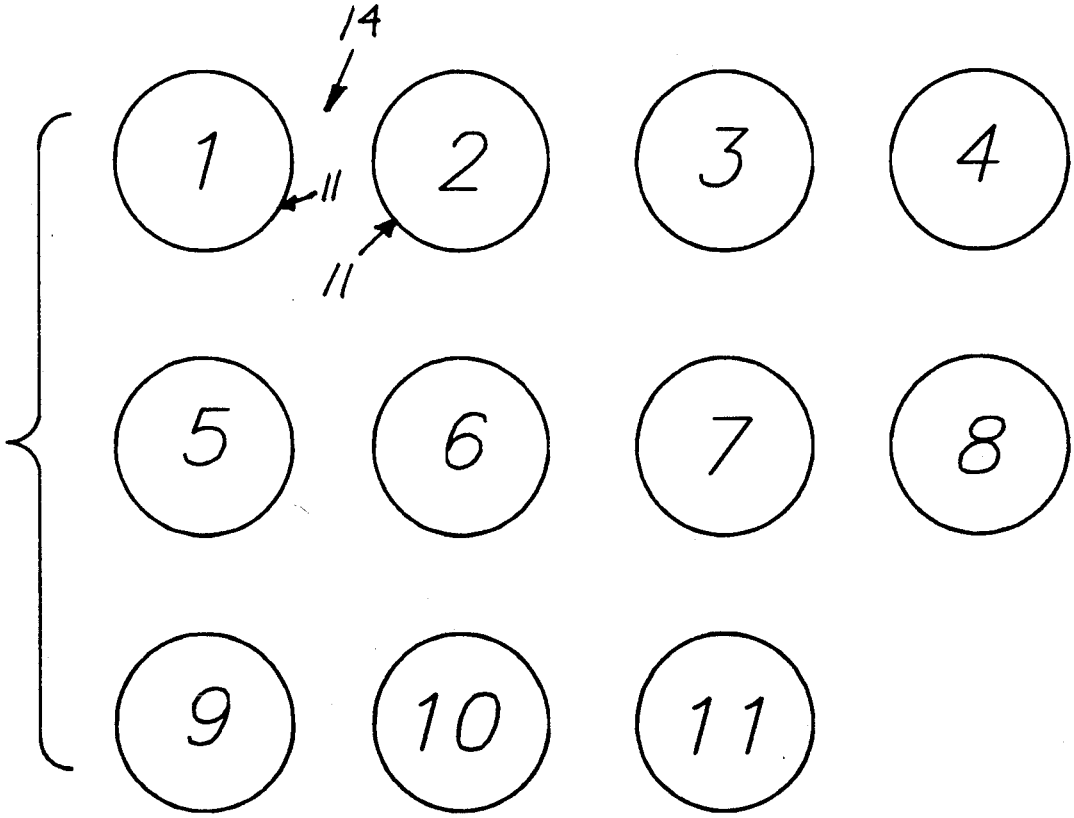
FIG. 4 is an orthographic top view of a set of support discs utilized by the invention.
Figure 5:
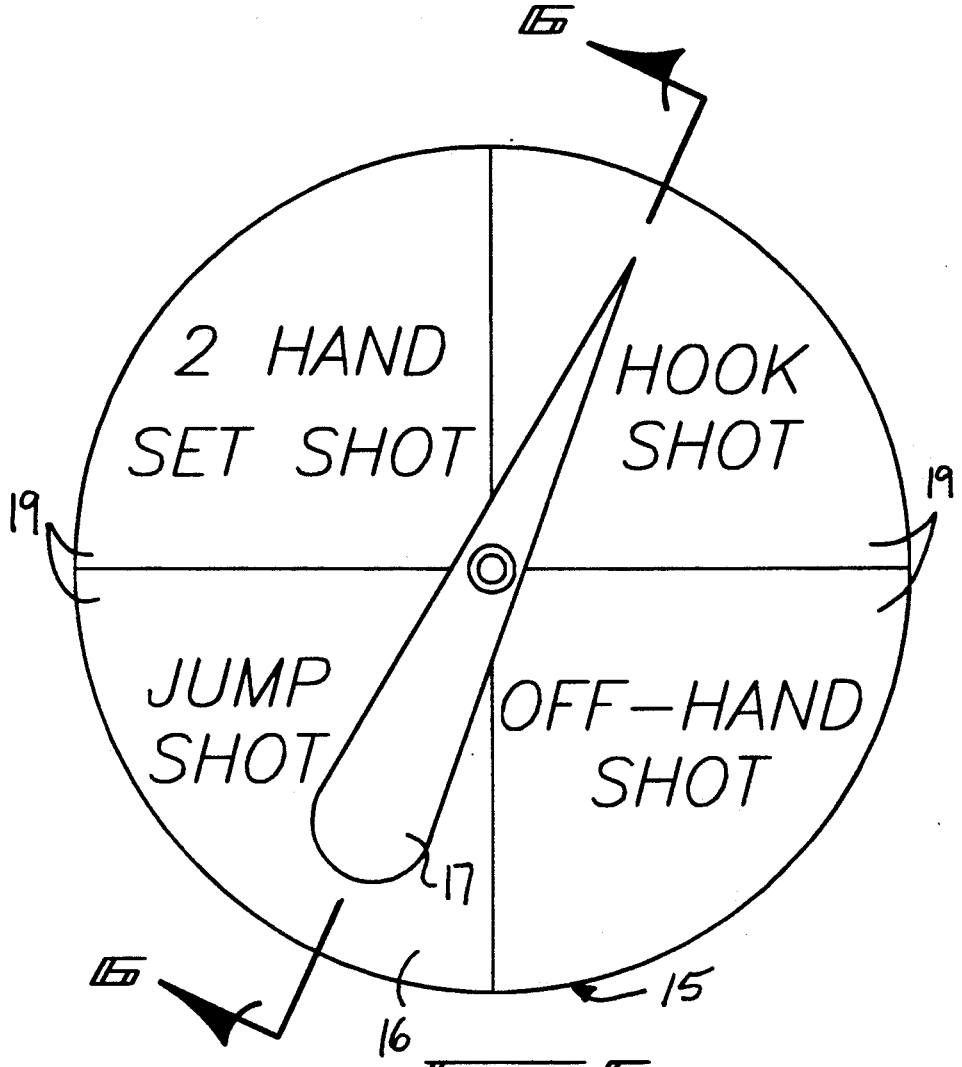
FIG. 5 is an orthographic top view of a spinner assembly utilized by the invention.
Figure 6:
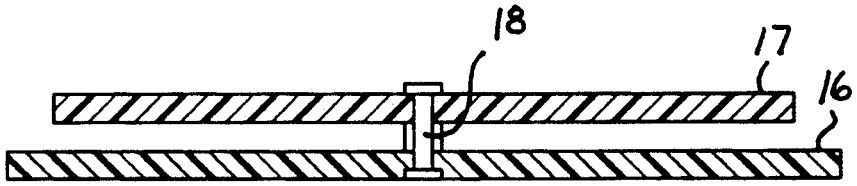
FIG. 6 is an orthographic view, taken along the lines 6—6 of FIG. 5 in the direction indicated by the arrows.
Figure 11:
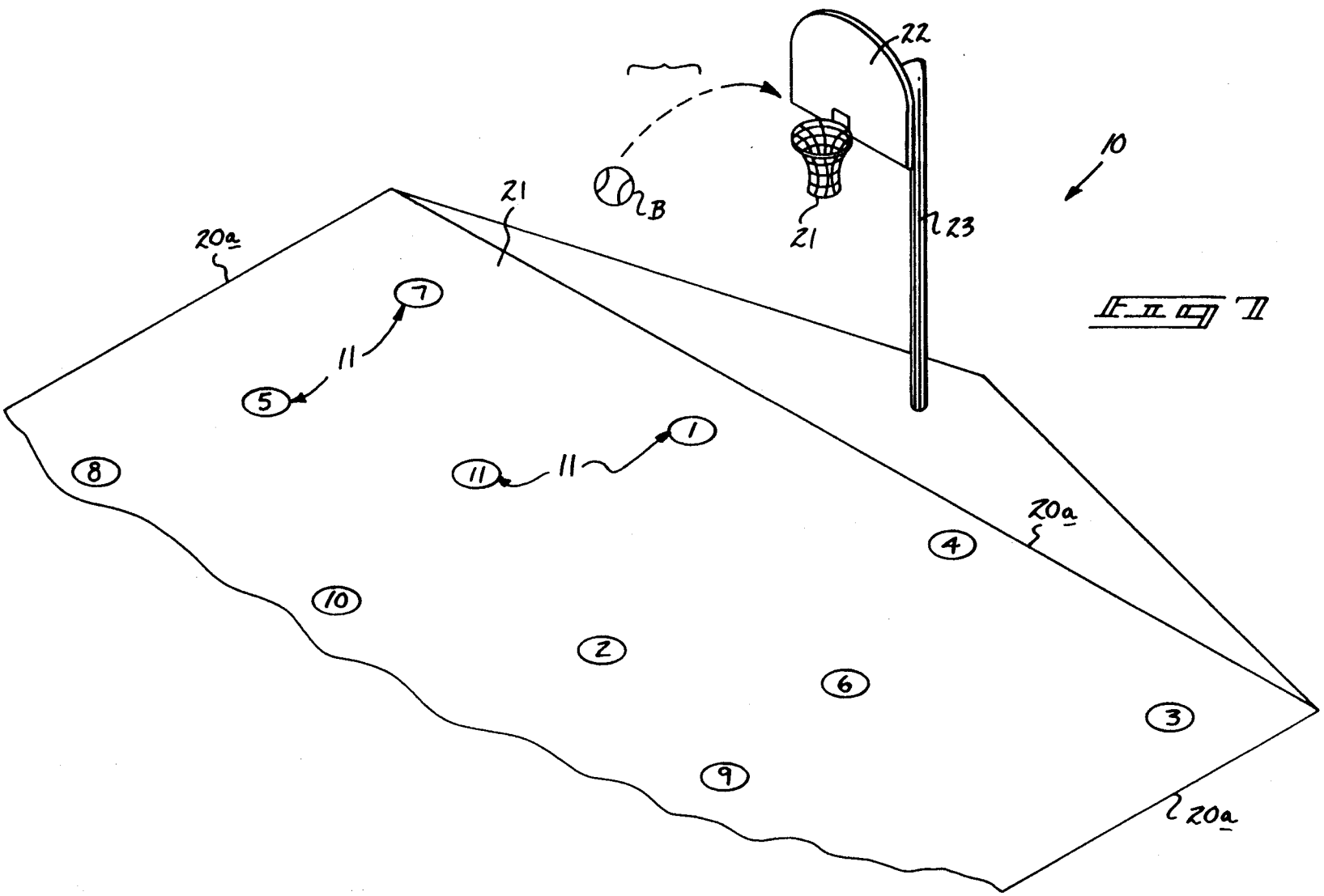

With reference now to the drawings, and in particular to FIGS. 1 to 9 thereof, a new and improved basketball game apparatus embodying the principles and concepts of the present invention and generally designated by the reference numeral 10 will be described.

More specifically, the basketball game apparatus 10 of the instant invention essentially comprises a matrix of flexible support discs 11 formed of a generally cylindrical configuration, including a top surface 12 coplanar to a bottom surface 13. Each disc 11 of a disc set 14 (see FIG. 4) sequentially numbered, to include ten to fifteen discs, is positioned in a spaced relationship about a basketball court surface 20 defined by encompassing boundary lines 20*a*. A support post 23 mounting a basketball backboard 22 and a basketball goal net 21 mounted fixedly to the backboard medially thereof is positioned adjacent the basketball court surface, wherein a player individually, or a player sequentially of a plurality of players, directs a basketball "B" from the sequentially numbered discs 11 of the disc set 14 that is positioned on the court surface, as illustrated in FIG. 7. Should a player miss a shot, the player will stay at the sequentially designated disc, such as disc 5 for example, until a subsequent turn. A player alternatively may take a second shot, but should that player miss that shot, he must return to the number 1 disc and begin the sequential traverse of the discs of the disc set 14.

To add a degree of complexity to the game, a spinner assembly 15 is provided to include a base plate 16 rotatably mounting a spinner 17 coaxially thereof rotatably mounted to a spinner axle 18. Spinner directional segments 19 are radially formed to a top surface of the base plate 16 to provide direction as to the type of basketball shot to be undertaken, such as "jump shot", "hook shot", and the like.

Figure 8:
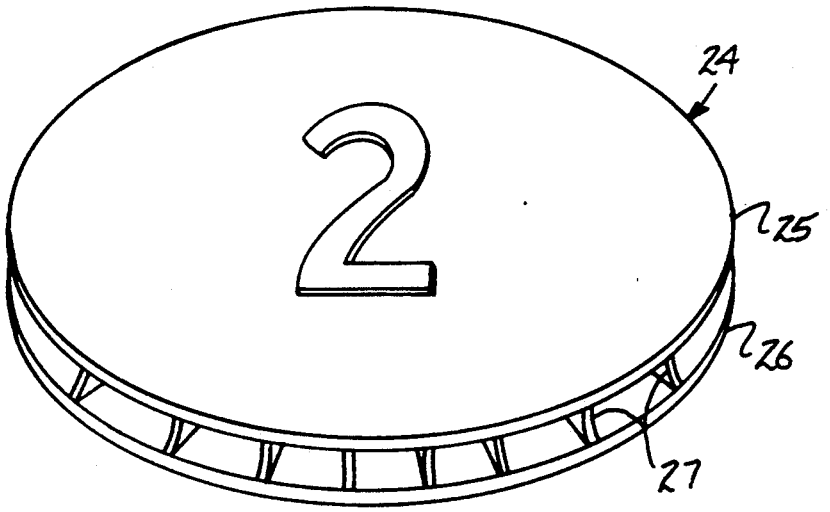
FIG. 8 is an isometric top view of a disc structure utilized by the invention.
Figure 9:
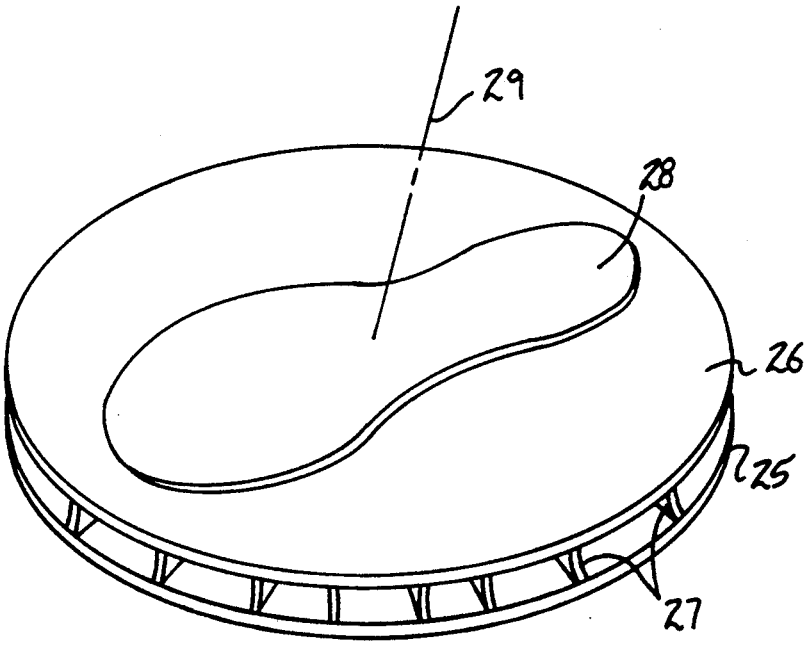
FIG. 9 is an isometric bottom view of the disc structure as set forth in FIG. 8.

FIGS. 8 and 9 illustrate the use of a modified disc structure 24 that includes a rigid top plate 25 of cylindrical configuration spaced from, parallel to, and coaxial with a rigid bottom plate 26. The top plate 25 and the bottom plate 26 are secured together by resiliently deformable radial vanes 27 fixedly mounted orthogonally between the top and bottom plates 25 and 26 in a circular array in a radial alignment relative to one another radiating from an axial concentric axis 29 between the top and bottom plates 25 and 26. In this manner, an individual positioned upon the rigid top plate 25 effects deformation by the radial vanes 27 in attempting a throw of the basketball "B" towards the net 21 to require that individual to accommodate body torquing of various types in directing a throw to the net 21. Further, the bottom plate 26 includes a foot receiving concave single depression 28 diametrically aligned below the top surface of the bottom plate 26. The top plate 25 is formed with a planar surface to permit an individual to position both feet thereon in throwing the basketball "B". It should be understood therefore that utilization of the modified disc structure 24 provides further complexity in utilization of the game as players advance in skill and ability.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A basketball game apparatus, comprising in combination with a basketball court, the basketball court including a court top surface, wherein the court top surface includes an encompassing plurality of boundary lines to define the court surface, and a basketball support post positioned adjacent the court surface extending orthogonally relative thereto, wherein the support post includes a backboard mounted to an upper terminal end of the support post, and the backboard including a basketball goal net mounted medially of the backboard, and a basketball sphere permitting at least one individual to project the basketball sphere from the court surface to the basketball net, and a plurality of disc members positionable within the court surface, the disc members sequentially numbered to provide for sequential positioning of the at least one player in throwing the basketball sphere towards a net from each of the discs, and a spinner assembly, the spinner assembly including a spinner assembly base and a spinner assembly arrow member rotatably mounted above the base about an axle, wherein the axle is directed medially of the base and arrow, and the base including a plurality of directional quadrants demarcated within a top surface of the base for indication of various directions to throw the basketball sphere to the net, and each disc includes a rigid top plate spaced from, parallel to, and coaxially aligned with a rigid bottom plate, the rigid top plate and the rigid bottom plate each of a cylindrical configuration, and the rigid top plate including a top plate top surface and the bottom plate including a bottom plate top surface, the top plate top surface formed of a coplanar configuration, and the bottom plate top surface including a foot-receiving concave depression diametrically aligned within the bottom plate top surface for receiving a single foot member of the at least one player.

2. An apparatus as set forth in claim 1 wherein resilient and deformable radial vanes are fixedly mounted in an orthogonal relationship between the rigid top plate and the rigid bottom plate, wherein the radial vanes are oriented in a circular array radiating from a central axis defined by the top plate and the bottom plate, wherein the radial vanes are arranged for deflection and limited rotation of the top plate relative to the bottom plate when the at least one player projects the basketball sphere to the basketball net.

* * * * *